United States Patent [19]

Adams

[11] Patent Number: 5,020,412

[45] Date of Patent: Jun. 4, 1991

[54] MISSILE LAUNCHER

[75] Inventor: Thomas P. Adams, Havant, England

[73] Assignee: The Secretary of State for Defence in Her Britannic Majesty's Government of the United Kingdom of Great Britain and Northern Ireland, London, England

[21] Appl. No.: 488,077

[22] PCT Filed: Jun. 19, 1989

[86] PCT No.: PCT/GB89/00067

§ 371 Date: Jun. 20, 1990

§ 102(e) Date: Jun. 20, 1990

[87] PCT Pub. No.: WO89/06777

PCT Pub. Date: Jul. 27, 1989

[30] Foreign Application Priority Data

Jan. 20, 1988 [GB] United Kingdom ..... 8801311

[51] Int. Cl.[5] ..... F41F 3/04

[52] U.S. Cl. ..... 89/1.805; 89/1.815

[58] Field of Search ..... 89/1.805, 1.801, 1.802, 89/1.803.1, 804, 1.819, 1.815, 1.816

[56] References Cited

U.S. PATENT DOCUMENTS

| | | | |
|---|---|---|---|
| 2,960,009 | 11/1960 | Hereth et al. | 89/1.805 |
| 3,088,375 | 5/1963 | Sherman | 89/1.805 |
| 3,101,026 | 8/1963 | Jacobson et al. | 89/1.805 |
| 3,106,132 | 10/1963 | Biermann et al. | 89/1.815 |
| 3,303,740 | 2/1967 | Grayson et al. | 89/1.815 |
| 3,865,009 | 2/1975 | Kongelbeck | 89/1.815 |
| 3,892,162 | 7/1975 | Phillips | 89/1.815 |
| 4,305,325 | 12/1981 | Lange et al. | 89/1.815 |
| 4,444,087 | 4/1984 | Hunter et al. | 89/1.802 |

*Primary Examiner*—David H. Brown

*Attorney, Agent, or Firm*—Nixon & Vanderhye

[57] ABSTRACT

A very short range missile launcher comprises a magazine (10) rotatable about a vertical axis and carrying a number of missiles (11, 35) vertically. An electronically steerable radar is mounted above the magazine. On perceiving a threat a wall member (12) hinged along its lower edge (13) and carrying a number of missiles loaded from the magazine is opened by an elevation control (18). An electro-optic tracker (17) is mounted on the hinged wall member for launch determination. Deflector plates (21) are mounted on the hinged wall to deflect the missile exhaust. In a further arrangement opposed end wall members (33, 34) carrying missiles are rotated by an elevation control (36, 37). Missiles are supported in the magazine between upper and lower conveyors (41, 42) operated by an indexing control (58, 59, 68) for loading missiles for launch.

14 Claims, 5 Drawing Sheets

MISSILE LAUNCHER

BACKGROUND OF THE INVENTION

1. Field of the Invention

The invention relates to the launching of projectiles and in particular to trainable launchers for operation on ships.

2. Discussion of Prior Art

Defensive weapon systems generally require a scanning target detection system, a trainable launcher for launching one or more projectiles towards the target and means to guide the projectiles to the target. known systems are complex and heavy, leading to reliability, cost and top-weight penalties when used in a marine environment.

SUMMARY OF THE INVENTION

The object of the invention is to provide a launcher to overcome above mentioned problems associated with existing launchers.

The invention provides a ship's projectile launcher comprising:

(a) a projectile magazine having walls defining an enclosure for storing projectiles and one wall member adapted to locate projectiles in a firing position;

(b) means to move projectiles from the stored position to the firing position; and (c) a plinth mounting cooperating with the magazine such that, in use, the magazine is rotatable about an axis parallel to the longitudinal axes of the projectiles;

the arrangement being such that the magazine wall member is rotatable about an axis perpendicular to the magazine rotation axis and a means is provided to move the wall member between the closed and a pivotally rotated open position whereby the projectiles in the firing position may be directed towards a target.

In an advantageous arrangement a target detection device is rotatably mounted on the magazine. Preferably an optical target tracker is located on the pivotal magazine wall.

In one embodiment the magazine is arranged such that the one wall member is hinged to the magazine and the wall member is pivotally movable from a closed position to a firing position. A hydraulic ram may be used to open the magazine. In this arrangement deflector plates are provided to deflect missile exhaust gases away from the magazine.

In a second embodiment the magazine comprises two opposed side walls and a means to retain missiles adjacent to the respective side walls and a further means to rotate the side walls together with the retained missiles to a firing position. Advantageously in this embodiment two colinear elevation shafts are connected to the side walls and these are arranged such that on initiation of the firing sequence the side walls are first moved away from the magazine and then rotated to the correct elevation angle for firing.

Preferably missiles are stored in at least one line between upper and lower conveyors, the conveyors being movable synchronously to move one or more missiles to a loaded position adjacent said at least one wall member. A releaseable retaining means is preferably provided to retain said loaded missiles. Conveniently the conveyors each comprise an endless belt moveable on pulleys around a carriage, indexing means to move the carriage from a first position to a second position adjacent said at least one wall member, means to lock the belt relative to the carriage and a further means to lock the belt relative to the magazine, the belt locking arrangement and the carriage movements being such that missiles can be transported from a stored position to a firing position as required. Preferably the endless belts are provided with locating holes for respectively engaging the top and bottom of each missile.

BRIEF DESCRIPTION OF THE DRAWINGS

The invention will now be described by way of example only with reference to the accompanying Drawings of which.

DETAILED DESCRIPTION OF PREFERRED EMBODIMENTS

Figure 1:
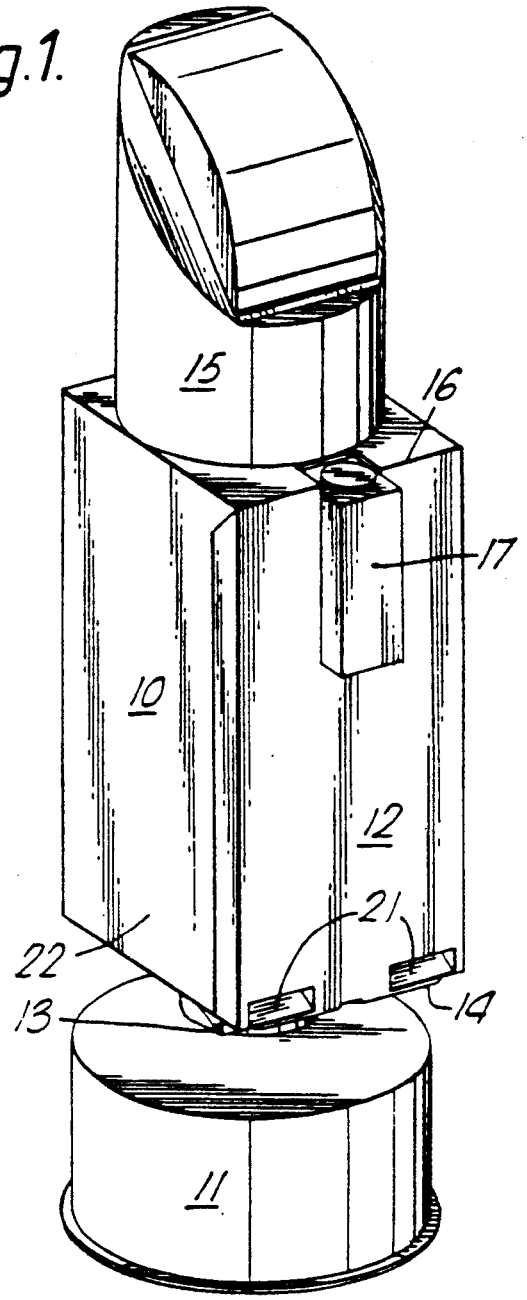
FIG. 1 shows a perspective view of a launcher in target detection mode.
Figure 2:
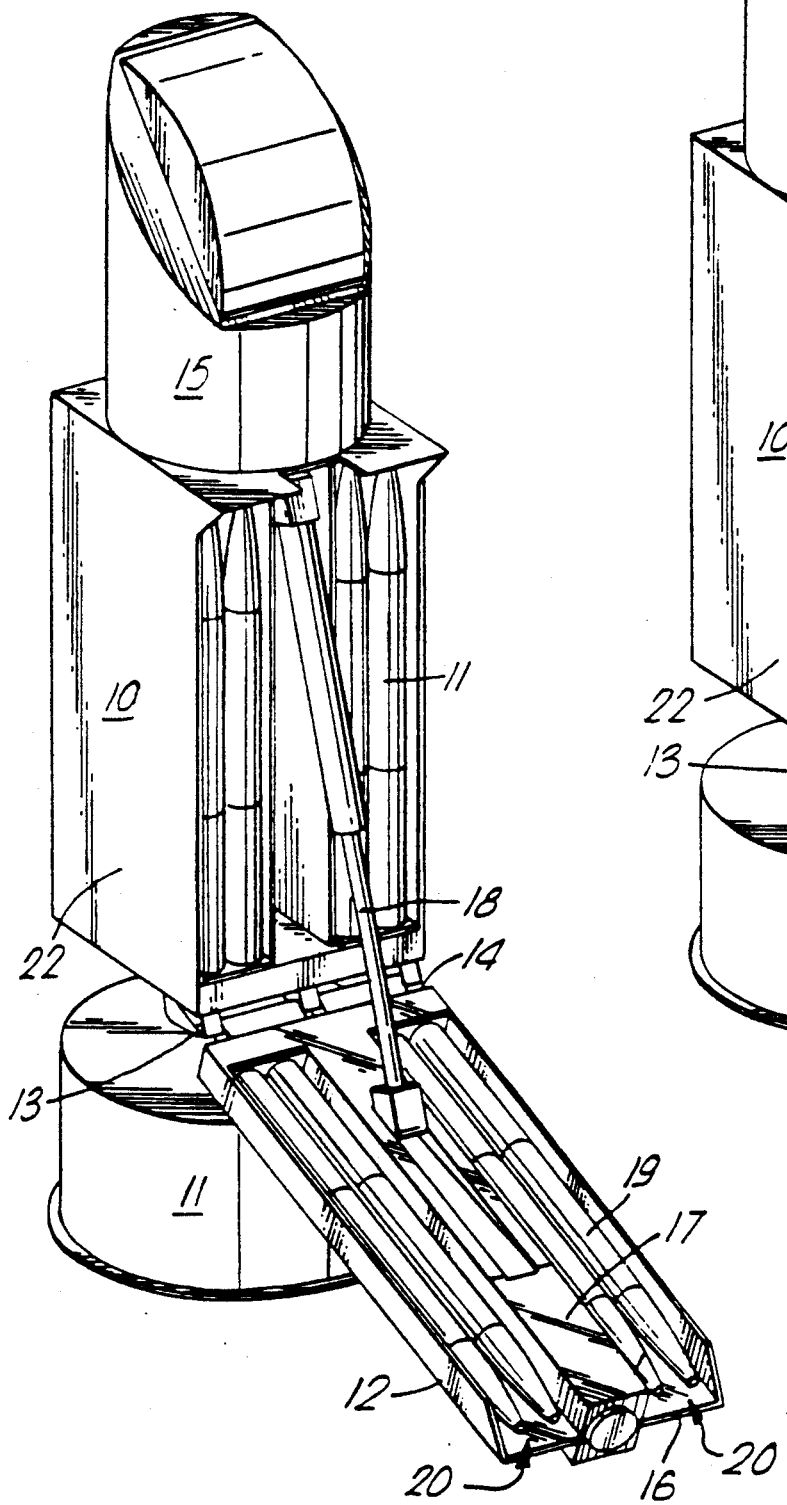
FIG. 2 shows the launcher in target tracking mode.

A ship's projectile launcher, shown in FIGS. 1 and 2, comprises a magazine 10 rotatably mounted on a plinth 11. One end wall 12 of the magazine 10 is attached to the magazine by means of a hinge 13 extending along the lower edge 14 of the end wall. A radar 15 is electronically stabilised and rotated about the vertical axis by a driven shaft (not shown) which extends through the magazine 10 such that there is no torque on the magazine. Movement of the launcher assembly due to snip motion is measured by an inertial reference unit situated in the plinth 11 which provides signals needed for electronic stabilisation of the radar 15. At the upper end 16 of the pivotal magazine wall 12 there is provided an electro-optic tracking sensor 17.

As can be seen in FIG. 2 the magazine wall 12 can be opened to a pre-determined zenith angle by means of a ram 18. Preferably the ram is hydraulic or pneumatic, however an electro-mechanical ram properly protected to prevent sparking could also be used. As shown the projectiles 19 are stored in side-by-side pairs in two columns. A conveying means (not shown) is provided inside the magazine to move the projectiles 19 towards the wall 12 so as to fill the two missile receptacles 20 provided in the wall 12. The projectiles will have retracted fins (not shown) for deployment in flight and are retained with sufficient separation in the wall receptacles 20 so that the projectiles do not mutually interfere on launch.

Drive motors for the magazine and radar unit are housed within the plinth 11. A "quill" drive is connected to the radar 15: a drive shaft located within a cylindrical housing lengthwise within the magazine such that torque effects on the magazine are minimal. At the base of the pivotal wall 12 there are provided two angled deflector plates 21, one at the base of each missile receptacle 20. The deflector plates 21 act to deflect projectile exhaust gases downwards and away from the magazine.

On firing a salvo of four projectiles there is little or no reaction moment on the elevation and azimuthal training drives. On completion of firing, the pivotal wall member 12 is closed for recharging with missiles from the magazine.

The invention provides a simple rugged solution which can be made lightweight, and cheaply. Where, for a particular application, the electro-optic sensor 17 cannot be located on the wall 12 it can pivotally mounted on the side 22 of the magazine with a link connected to the pivotal wall 12 such that the axial of the sensor 17 is parallel to the projectile 19.

Figure 3:
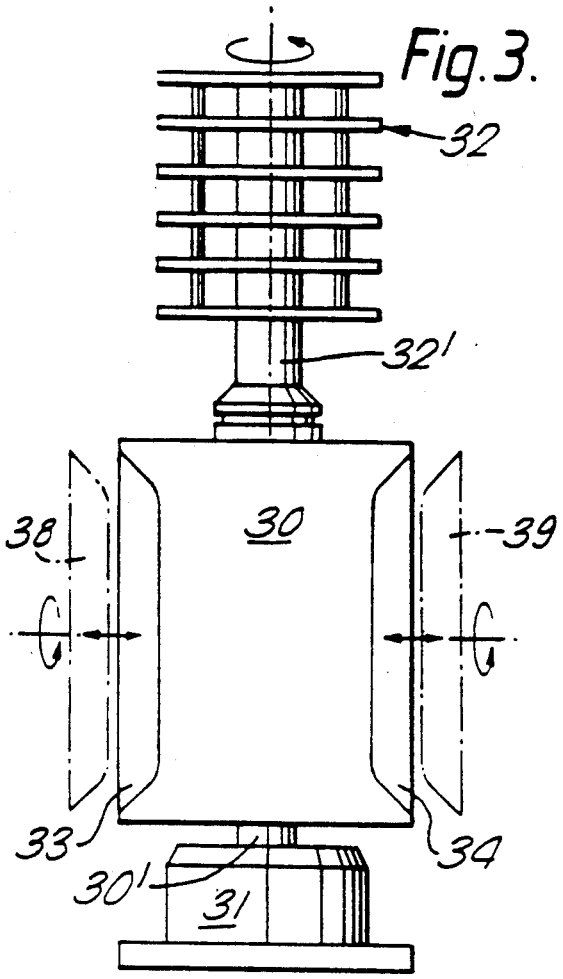
FIG. 3 shows a side elevation of an alternative arrangement of the launcher.
Figure 4:
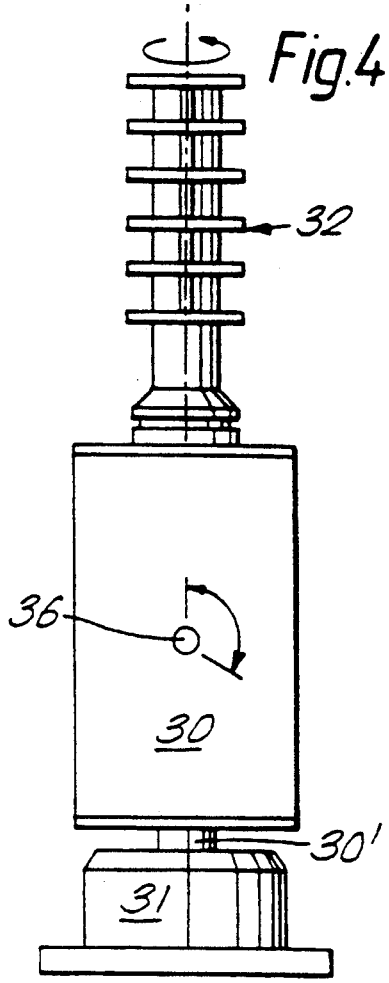
FIG. 4 is a side elevation perpendicular to the FIG. 3 view.
Figure 5:
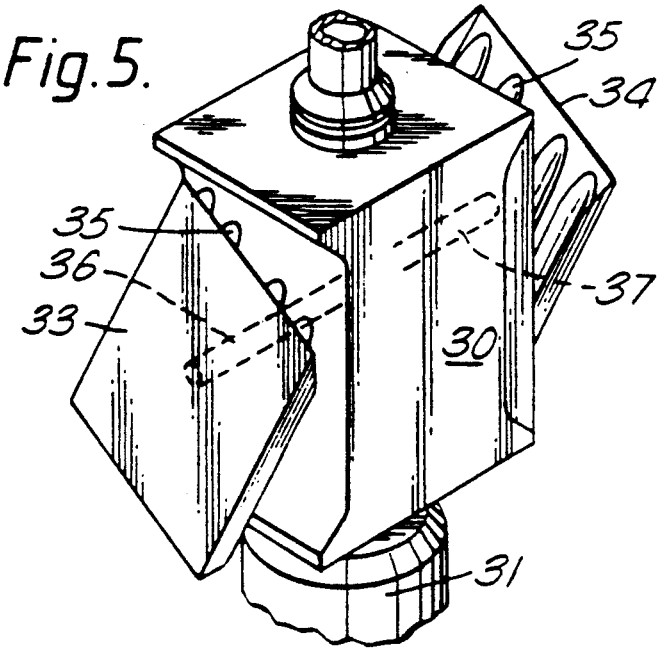
FIG. 5 is a perspective view of the FIG. 3 launcher in target tracking mode.
Figure 6:
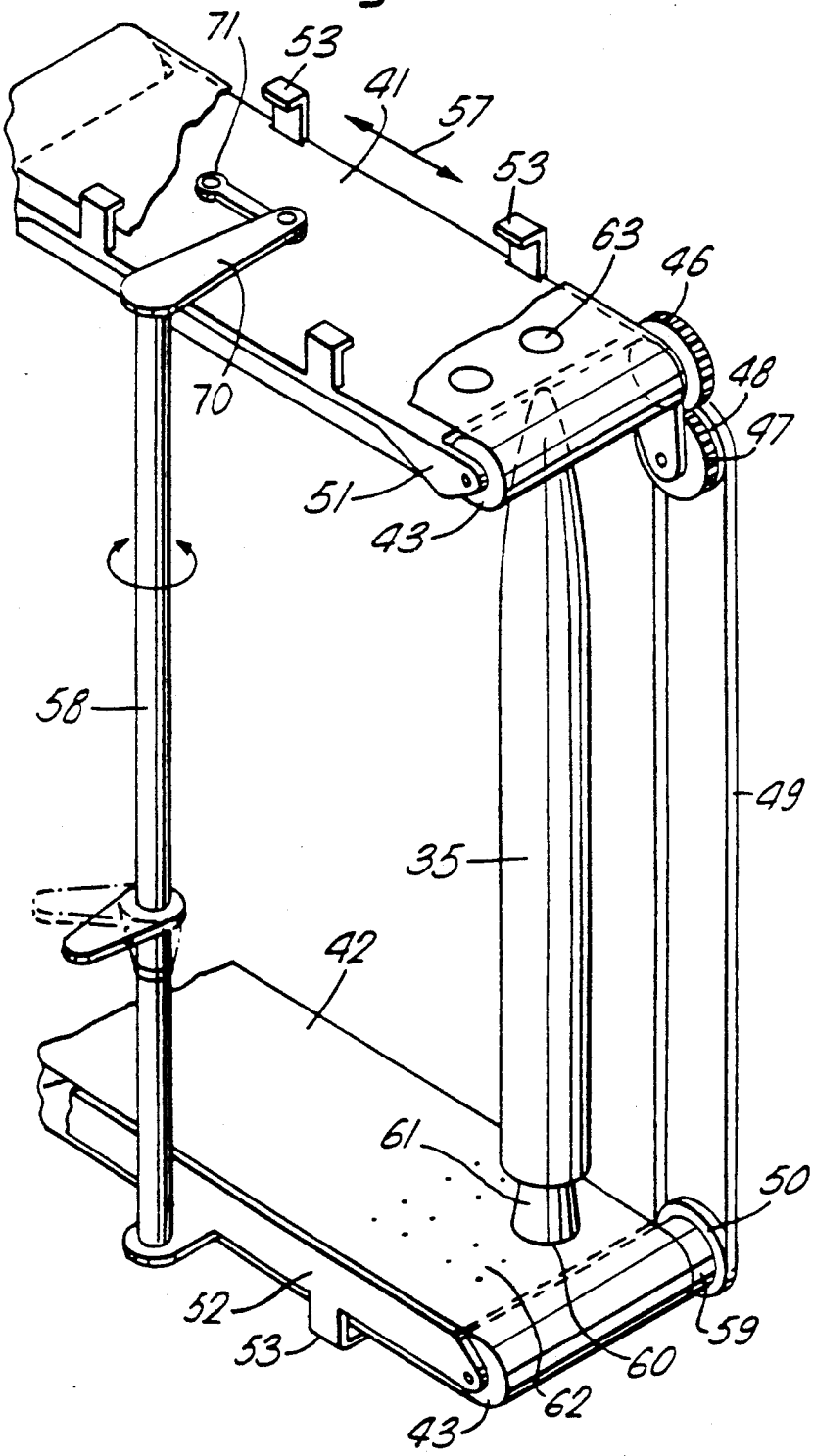
FIG. 6 is a perspective view, part cut away, of a missile conveyor arrangement.

FIGS. 3–5 show an alternative arrangement of the invention. As in the previous arrangement a magazine 30 is rotatably mounted on a plinth 31 with missiles stored vertically in the magazine. A radar 32 is mounted on top of the magazine 30 for rotation about axis 32' colinear with the magazine rotation 30' axis. Two opposed wall members 33,34 of the magazine 30 are provided to move missiles 35 from a stored position to a firing position as shown in FIG. 5. Two colinear half shafts 36,37 are connected to the respective wall members 33 and 34. On initiating target tacking the two shafts 36,37 move axially away from one another to thereby move the wall members 33,34 from closed positions to open positions indicated by the broken lines 38,39. From the open position, rotation of the shafts 35,36 alters the elevation of four missiles, as shown, located in each of the wall members 33,34 and rotation of the magazine about the plinth axis 30' alters the azimuth angle of the missile.

Figure 9:
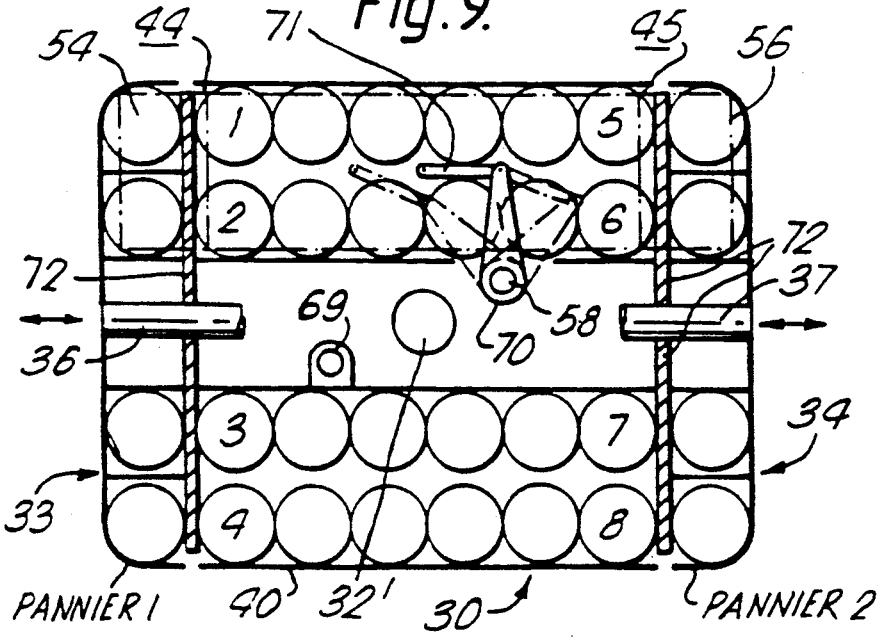
FIG. 9 is a schematic plan section for illustrating the missile loading sequence.
Figure 10:
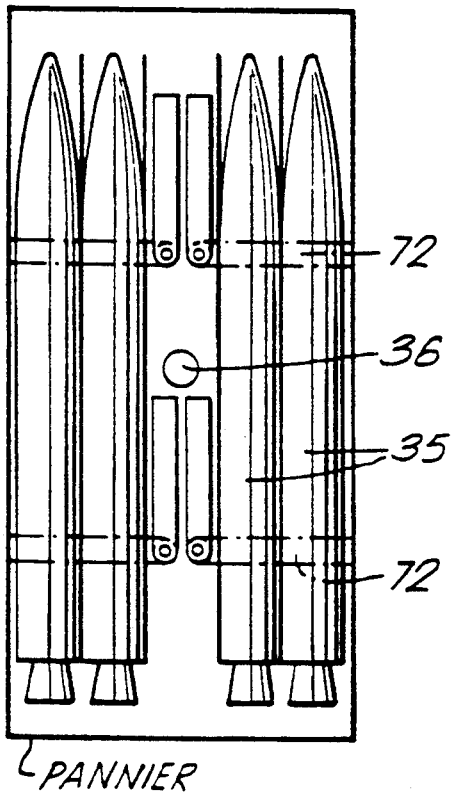
FIG. 10 is a cut away end view of the launcher showing the mechanism for retaining the missiles in the launch position.

FIGS. 6–10 illustrate one mechanism for loading the missile 35 in the launching position on the wall members 33 and 34. As can be seen particularly with reference to FIGS. 6 and 9 the missiles are located in two lines arranged side-by-side adjacent each long fixed side 40 of the magazine 30. Each pair of lines of missiles 35 is located in the magazine between upper and lower continuous conveyor belts 41 and 42 rotatable about pulleys 43 extending along the magazine between positions 44 and 45 when centralised (FIG. 9). One upper pulley 43 has an axially connected toothed gear 46 engaging a similar toothed gear 47 which has a toothed portion 48 driving a toothed belt 49 engaging a similar toothed portion 50 on the lower pulley 43 beneath the toothed gears. The toothed belt 49 ensures that the upper and lower conveyor belts remain in register. The pulleys 43 are located at each end of upper and lower carriages 51 and 52. Upstanding lugs 53 on both sides of the two carriages 51 and 52 are provided to locate the carriages between complementary lugs on the upper and lower members of the magazine (54 in FIG. 8) such that the carriages can be selectively slid axially together towards wall member 33 or 34 (position 55 or 56), as indicated by arrows 57 on rotation of an indexing rod 58. A pulley brake (indicated by reference numeral 59) is provided such that the conveyor movement relative to the carriages can be locked. Each missile is provided with a number of spigots 60 on the expansion cone 61 to engage holes 62 provided therefore in the lower conveyor belt 42. The upper belt is also provided with holes 63 to engage the noses of the missiles.

Figure 7:
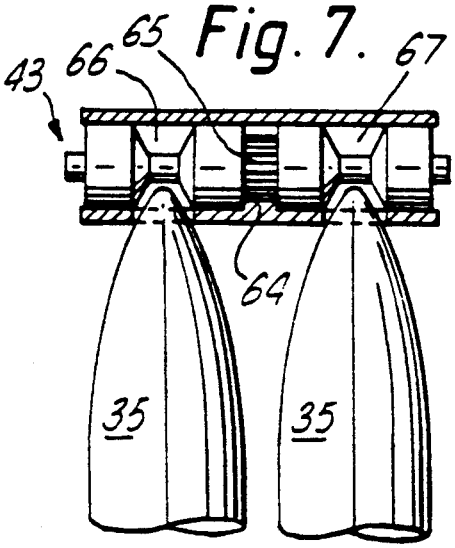
FIG. 7 is a sectional view through one pulley carrying the upper conveyor belt of FIG. 6.
Figure 8:
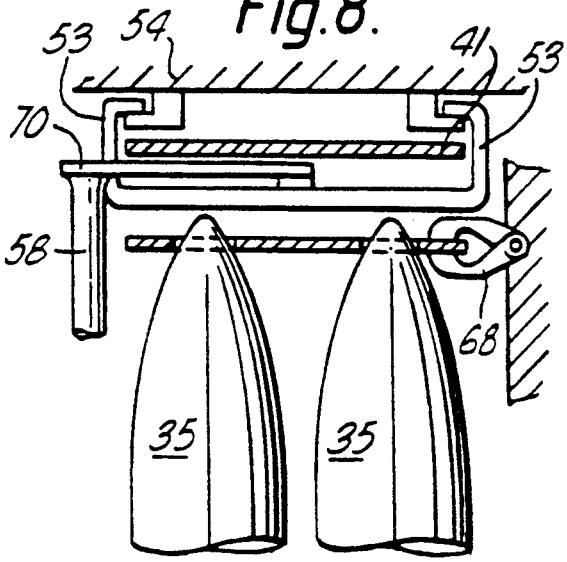
FIG. 8 is an illustrative section through the upper conveyor of FIG. 6 showing the conveyor carriage support and conveyor belt brake arrangements.

As can be seen in FIG. 7 the conveyor belts 41 and 42 are formed with a central longitudinally extending toothed section 64 engaging a complementary geared portion 65 on the respective pulleys 43. The upper pulleys 43 are cut away to produce two axially spaced portions 66,67 of reduced radial extent to allow passage of the missile noses. A belt brake 68 fixed to the side of the magazine is provided to lock the conveyor belts relative to the magazine.

Operation of the loading mechanism, assuming that both wall launchers (33 and 34) are initially empty, is as follows:

1. Engage the pulley brake 59.
2. Move the indexing rod 58 connected to one pair of side carriages 51,52 of one missile lane and the indexing rod 69 connected to the other missile lane so as to move pivoted links 70,71 connecting the indexing rods to the carriages from position (2) to position (1).
3. Energise retaining wings 72 on launch wall 33 (FIG. 10) to retain missiles 1–4
4. Release pulley brake 59 and engage belt brake 68.
5. Move indexing rods 58,69 from position (1) to (2), leaving launch wall 33 loaded with missiles 1–4 (FIG. 9).
6. Release belt brake 68 and engage pulley brake 59.
7. Move indexing rods from position (2) to position (3).
8. Disengage pulley brake 59 and engage belt brake 68.
9. Move indexing rods from position (3) to position (2).
10. Disengage belt brake 68 and engage pulley brake 59.
11. Move indexing rods from position (2) to position (3), leaving missiles 5–8 loaded in launch wall 34.
12. Energise retaining wings 72 on launch wall 34.
13. Disengage pulley brake 59 and engage belt brake 68.
14. Move indexing rods from position (3) to position (2) leaving launch wall 34 loaded and ready to fire missiles 5–8.

The launcher arrangement illustrated in FIGS. 3–10 having side launch "panniers" in place of a front opening door offers three main advantages:

(a) Improved channels of fire-one pannier can be loaded as the other is being fired;

(b) Improved balance compared to the front door arrangement; and (c) Problems due to missile efflux on rounds remaining in the magazine are minimised.

By moving apart the side panniers prior to rotation, weather sealing of these units to the body of the magazine is facilitated. It is nevertheless possible for the side wall panniers to be rotated directed from the closed condition providing a suitable sealing arrangement is provided.

I claim:

1. A ship's projectile launcher comprising:

(a) a projectile magazine (10) having walls defining an enclosure for storing projectiles and one wall member (12, 33, 34) adapted to locate projectiles (19) in a firing position;

(b) means (41, 42) to move projectiles from the stored position to the firing position; and (c) a plinth mounting (11) cooperating with the magazine such that, in use, the magazine is rotatable about an axis parallel to the longitudinal axes of the projectiles;

the arrangement being such that the magazine wall member (12, 33, 34) is rotatable about an axis perpendicular to the magazine rotation axis and a means (18, 36,

37) for moving the wall member between the closed and a pivotally rotated open position whereby the projectiles in the firing position may be directed towards a target.

2. A ship's projectile launcher as claimed in claim 1 wherein a target detection device (15, 32) is rotatably mounted on the magazine.

3. A ship's projectile launcher as claimed in claim 1 wherein an optical target tracker (17) is located on the pivotal magazine wall.

4. A ship's projectile launcher as claimed in claim 1 wherein the magazine comprises two opposed side walls (33, 3) and a means (72) to retain missiles adjacent to the respective side walls wherein said means for moving includes means for simultaneously rotating the side walls together with the retained missiles to a firing position.

5. A ship's projectile launcher as claimed in claim 4 wherein said means for moving further comprises two colinear elevation shafts (36, 37) connected to the side walls (33, 34) and these are arranged such that on initiation of the firing sequence the side walls are first moved away from the magazine and then rotated to the correct elevation angle for firing.

6. A ship's projectile launcher as claimed in claim 1 wherein the magazine is arranged such that the one wall member (12) is hinged to the magazine and the wall member is pivotally movable from a closed position to a firing position.

7. A ship's projectile launcher as claimed in claim 6 wherein a hydraulic ram (18) is used to open the magazine.

8. A ship's projectile launcher as claimed in claim 7 wherein deflector plates (21) are provided to deflect missile exhaust gases away from the magazine.

9. A ship's projectile launcher as claimed in claim 1 wherein missiles (35) are stored in at least one line between upper and lower conveyors (41, 42), said launcher including means for synchronously moving at least one missile to a loaded position adjacent said at least one wall member.

10. A ship's projectile launcher as claimed in claim 9 wherein a releaseable retaining means (72) is provided to retain said loaded missiles.

11. A ship's projectile launcher as claimed in claim 9 wherein the conveyors each comprises an endless belt (41, 42) moveable on pulleys (43) around a carriage (51, 52) indexing means (58) to move the carriage from a first position to a second position adjacent said at least one wall member, means (59) to lock the belt relative to the carriage and a further means (68) to lock the belt relative to the magazine, the belt locking arrangement and the carriage movements being such that missiles can be transported from a stored position to a firing position as required.

12. A ship's projectile launcher as claimed in claim 11 wherein the endless belts are provided with locating holes (62, 63) for respectively engaging the top and bottom of each missile.

13. A ship's projectile launcher comprising:

(a) a projectile magazine including walls defining an enclosure for storing projectiles and one wall member adapted to locate projectile in a firing position; means mounting said magazine wall member for rotation about an axis perpendicular to the magazine rotation axis and a means for moving the wall member between the closed and a pivotally rotated open position;

(b) a plinth mounting means, cooperating with the magazine, for rotating said magazine about an axis parallel to the longitudinal axes of the projectiles; and (c) an upper and a lower conveyor between which missiles are stored in at least one line, each conveyor comprising an endless belt moveable on pulleys around a carriage, indexing means for moving said carriage from a first position to a second position adjacent said at least one wall member, means for locking said belt relative to the carriage and a further means for locking said belt relative to the magazine, both said belt locking means and said indexing means comprising a means for moving said missiles from a stored position to a firing position as required.

14. A ship's projectile launcher as claimed in claim 13 wherein the endless belts are provided with locating holes for respectively engaging the top and bottom of each missile.

* * * * *